United States Patent [19]

DeClark et al.

[11] 4,423,613

[45] Jan. 3, 1984

[54] GRAVITY ACCELERATED SHOT TREATING APPARATUS

[75] Inventors: Bruce W. DeClark, Walker; Joseph H. Weber, Grand Rapids, both of Mich.

[73] Assignee: Progressive Blasting Systems, Inc., Grand Rapids, Mich.

[21] Appl. No.: 300,948

[22] Filed: Sep. 10, 1981

[51] Int. Cl.[3] ..... B21J 5/00

[52] U.S. Cl. ..... 72/53

[58] Field of Search ..... 72/53, 40; 51/428, 431

[56] References Cited

U.S. PATENT DOCUMENTS

| | | | |
|---|---|---|---|
| 937,180 | 10/1909 | Ridd | 72/53 |
| 2,881,506 | 4/1959 | Fuchs | 72/53 |
| 3,705,511 | 12/1972 | Brandel | 72/53 |
| 4,067,240 | 1/1978 | Straub | 72/53 |

FOREIGN PATENT DOCUMENTS

| | | | |
|---|---|---|---|
| 143742 | 9/1980 | Fed. Rep. of Germany | 72/53 |

*Primary Examiner*—Gene P. Crosby

*Attorney, Agent, or Firm*—Price, Heneveld, Huizenga & Cooper

[57] ABSTRACT

Apparatus for treating workpieces with gravity accelerated shot in which the workpieces are impacted by the impingement of the shot. The apparatus includes unique means for handling the shot to cause it to freely fall and impinge uniformly on the workpieces. This unique means includes the provision for two chambers arranged back-to-back, one containing an elevator assembly which elevates the shot upwardly to the top of the other impact chamber which includes a bucket assembly for catching the shot. The uniformity of the shot stream is created by providing a perforated plate or screen and controlling the depth of the shot above the screen.

16 Claims, 10 Drawing Figures

GRAVITY ACCELERATED SHOT TREATING APPARATUS

BACKGROUND OF THE INVENTION

This invention relates to the treatment of articles for workpieces by means of subjecting them to impingement by media which is free-falling and gravity-accelerated. More particularly, this invention relates to the means for handling the media, such as steel shot, to cause it to freely fall and impinge uniformly on a workpiece, such as a turbine blade.

The present invention is related to the apparatus as disclosed in patent application Ser. No. 300,947, entitled ARTICLE MANIPULATOR MECHANISM FOR ACCELERATED SHOT PEEING APPARATUS, filed on Sept. 10, 1981, such application having inventors and assignee in common, and the disclosure thereof being incorporated by reference. In the above-identified patent application apparatus for shot peening comprises the impacting of articles or workpieces with uniformly sized spherical steel shot accelerated by the force of gravity created by the shot freely falling in space.

The object of the apparatus disclosed in such patent application is to uniformly treat predetermined surfaces of the workpieces in a uniform manner so that each workpiece is subjected to the same peening intensity. In so doing, it is important that the media be properly handled so that when it is dropped from an elevation and is freely falling to gain the acceleration and velocity necessary to impact the surfaces of the workpiece, the intensity of the impact on any given workpiece is proper for the purpose intended.

In addition, as disclosed in the above-identified application, it is desired to uniformly shot peen a multiple of workpieces in one operation. Therefore, it is necessary that the shot stream be uniform across the entire width of the article or articles being treated. Consequently, there is a need for improved apparatus for handling the media or shot to produce an optimum gravity accelerated shot stream for treatment of workpieces by such stream.

SUMMARY OF THE INVENTION

In accordance with the present invention, we have solved this need for a reliable gravity accelerated shot stream that will uniformly treat an article or articles across the entire width of the stream.

In accordance with this invention, a housing is provided with an elevator chamber and an impact chamber. The shot is dropped from an upper end of the impact chamber on a screen located intermediate the upper and lower end of the impact chamber. Below the stream is a support means for supporting workpieces which are impacted by the stream of shot falling through the screen. After impacting the workpieces, the shot falls downwardly into the lower end of the impact chamber where it is carried to the lower end of the elevator chamber wherein the elevator carries the shot upwardly to an elevated position in the upper end of the impact chamber. It has been found to be extremely important to drop the shot onto the screen uniformly along its entire length in order that the workpiece or workpieces are treated uniformly. Therefore, in accordance with this invention, the elevator means has a plurality of elongated media carriers extending along the width of the elevator chamber, the length of the carriers being substantially the same length as the screen for feeding the shot evenly along the entire length of the screen.

We have also conceived of sensing the depth of the media throughout the length of the screen and for that purpose we have provided two probes at each end of the screen so as to monitor the depth of the media or shot.

In accord with this invention, we further provide a bucket assembly located between the upper end of the impact chamber and the portion of such chamber where the workpieces are supported. This bucket is an integral unit having the screen located in the bottom thereof and a door for shutting off the flow of the shot or media through the screen. Within a preferred embodiment of this invention, means is provided for vertically adjusting the position of the bucket within the impact chamber so that the height from which the shot is dropped can be varied to control the impact intensity of the shot on the workpiece or workpieces.

Through trial and error, we have also discovered the optimum size and spacing of the openings in the perforated plate or screen through which the shot falls.

Within a more narrow aspect of this invention, the elevator buckets are constructed to be especially adaptable for the conveyance of the media from the elevator chamber to the impact chamber. For this purpose, the buckets which carry the shot upwardly are mounted on this carrier means in parallel relation to each other. The buckets in vertical cross section have at least two sides, one extending in a vertical direction and the other being inclined to the vertical direction. The two sides are secured together to form a cup-like structure when moving in an upward direction; however, when moving downwardly, the inclined side is inclined toward the first chamber. Thus, when conveyed by the endless carrier means, from an upwardly moving position to a downwardly moving position, the inclined side is located in the path of the media being dumped by a bucket located above it causing the deflection of the media in a direction toward and into the first chamber.

Further, in accord with this invention, the endless carrier means which is preferably constructed of link chain is directed at the lower end of the elevator chamber by a toothless sprocket to eliminate interference by the media or shot between the sprocket and the chain.

These and other objects, advantages and features of the invention will be more fully understood and appreciated by reference to the written specification made in conjunction with the appended drawings.

DESCRIPTION OF THE PREFERRED EMBODIMENT

Figure 1:
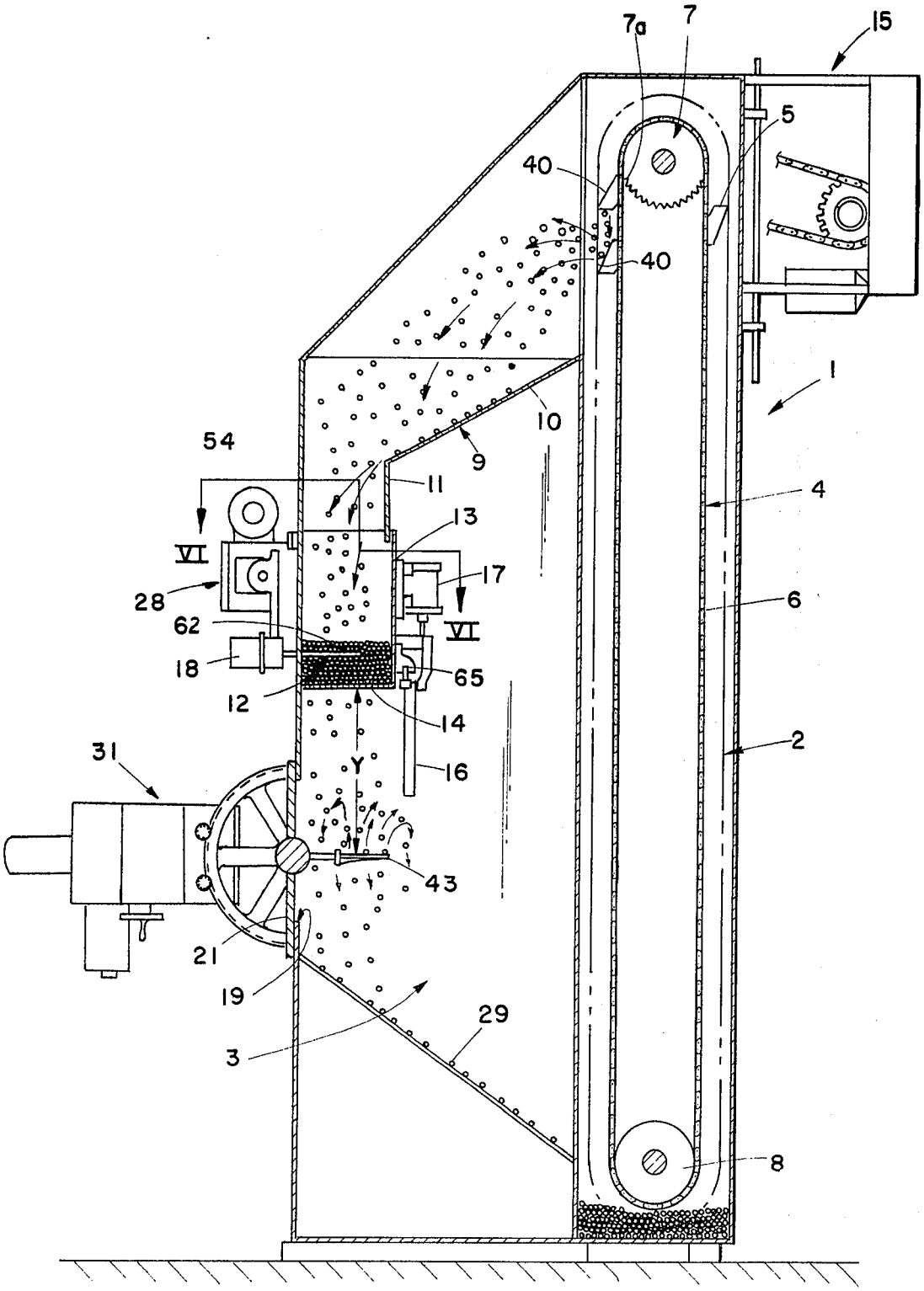
FIG. 1 is a side-elevational, cross-sectional view of a sketch of the entire apparatus of which this invention is a part.

Referring specifically to the drawings, reference numeral 1 designates the housing for the apparatus. Housing 1 includes two chambers, an elevator chamber 2 and an impact chamber 3. Located within the elevator chamber is the elevator assembly 4 having a plurality of elongated buckets 5 mounted on spaced endless chains 6 which ride on the conventional sprocket 7 and toothless sprocket 8. The elevator 4, driven by the elevator drive assembly 15, picks up the media, which preferably comprises steel shot, and elevates the same to deliver the shot into the impact chamber 3. The impact chamber includes a funnel-like member 9 having the inclined wall 10 terminating into a flange 11 that fits into and directs the shot into a bucket assembly 12. The bucket assembly includes the bucket 13 having mounted in its bottom a perforated metal plate or so-called screen 14. At one edge of the bucket 13 is pivotally mounted the bucket door 16 which is adapted to be opened and closed by the air cylinder 17. Also mounted in the bucket are the probes 62 of sensors 18 to sense the level of the media or shot in the bucket.

Figure 3:
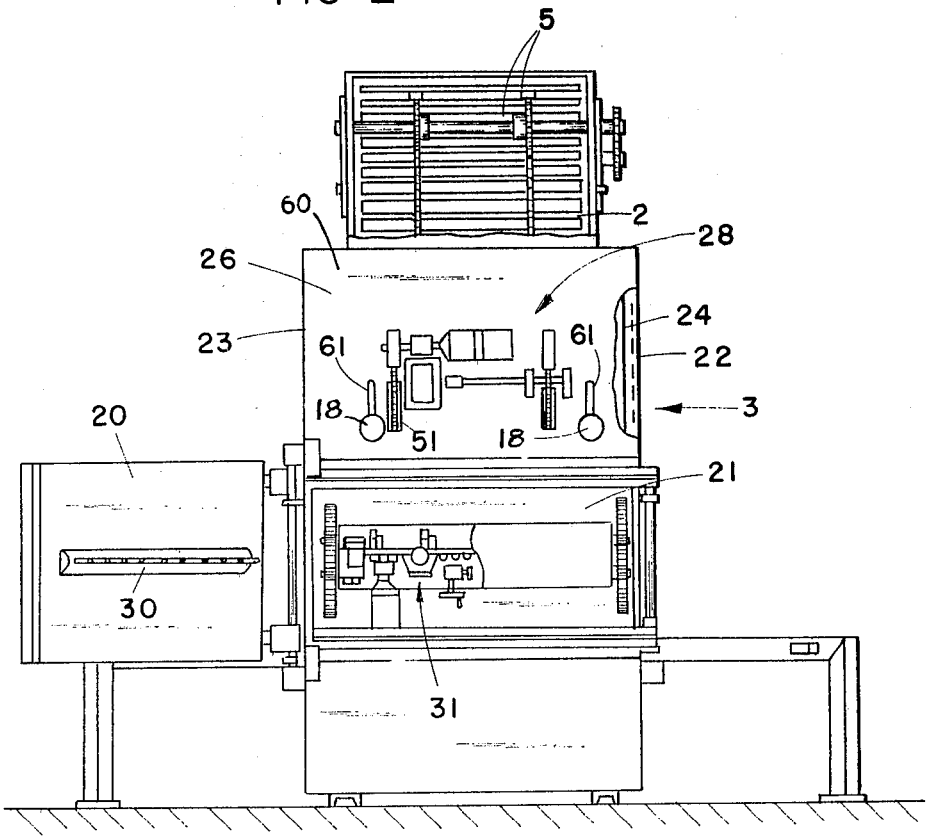
FIG. 3 is a front-elevational view of the apparatus.
Figure 5:
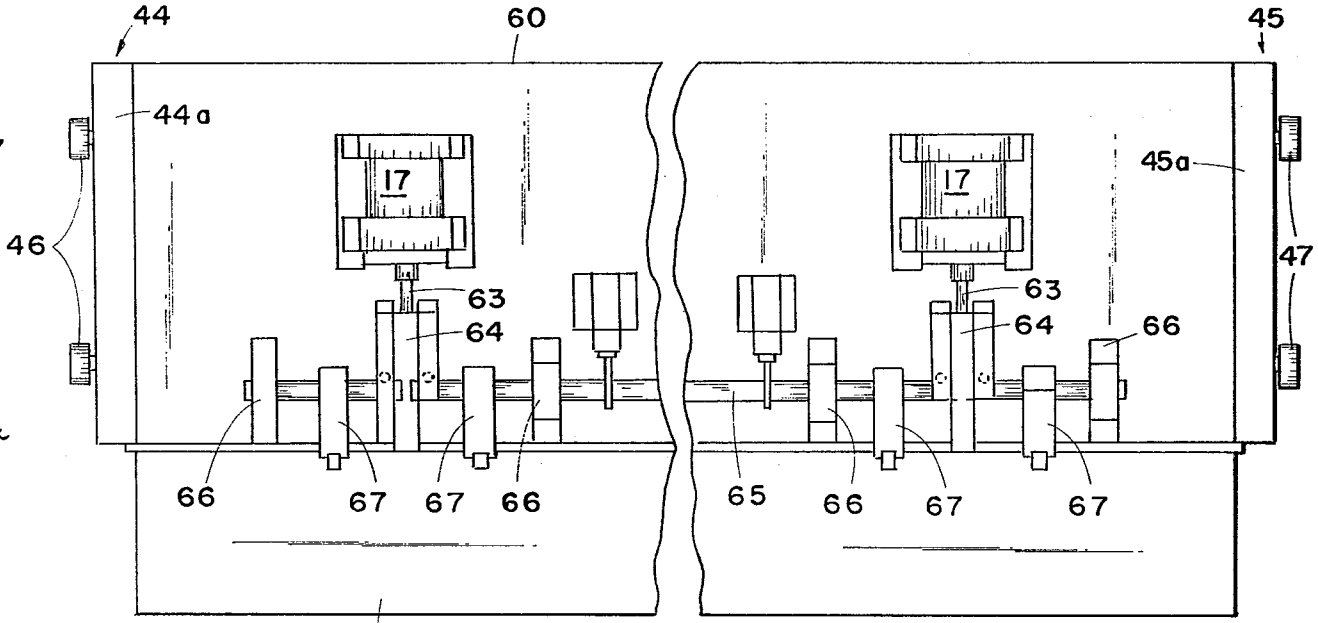
FIG. 5 is a rear-elevational view of the bucket assembly.

The chamber 3 has an opening 19 which as disclosed in FIG. 3 has two doors 20 and 21 interchangeably closing the same. These two doors 20 and 21 are identical except that one is a right hand door and the other is a left hand door. Each of these doors constitutes an enclosure panel upon which the manipulating mechanism assembly 30 or 31 is mounted. It should be understood that the construction of the doors 20 and 21 and the manipulator mechanism assemblies 30 or 31 mounted on the doors are disclosed in our pending patent application Ser. No. 300,947, entitled ARTICLE MANIPULATOR MECHANISM FOR ACCELERATED SHOT TREATING APPARATUS, filed on Sept. 10, 1981, and that such construction disclosed in that patent application is being incorporated by reference in this application.

The essence of our invention covered by this patent resides in the means for handling the media or shot, such means including the arrangement of the two chambers 2 and 3, the elevator assembly 4 within the chamber 2, the arrangement of the funnel 9, and the construction of the bucket assembly 12 which, as will be described, includes the sensing means 18 within the bucket 13, the door 16 for closing off the flow of the shot through the screen 14, the size and spacing of the openings in the perforated plate or screen 14, and the adjustment mechanism 28 for vertically adjusting the height of the bucket assembly.

Figure 2:
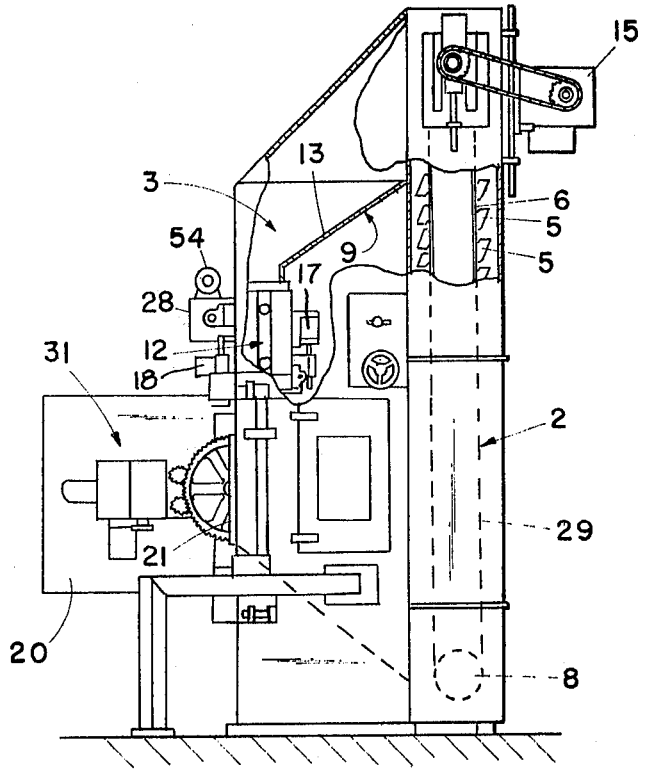
FIG. 2 is a side-elevational, partially cutaway view of the apparatus.

Referring separately to each of the above features of this invention, FIGS. 1, 2 and 3 best disclose the arrangement of the elevator chamber 2 and the impact chamber 3, these two chambers having width dimensions greater than their depth dimensions. The elevator chamber 2 is located directly behind the impact chamber 3 and is provided to feed shot at the upper end of the impact chamber and receive the shot from the lower end of the impact chamber. Thus, the circuitous path for the shot starting at the lower end of the elevator chamber 2 is as follows. First, the shot is elevated by the elevator assembly 4 to the top end of the elevator chamber 2 from whence it is dropped downwardly through funnel 9 into the bucket 13. Then the shot drops through screen 14 onto the workpieces 43, which are supported and manipulated in the shot stream by the manipulator mechanism assembly 31, and to the inclined bottom 29 of impact chamber 3 which returns the shot to elevator chamber 2. It will be evident the arrangement of the chambers 2 and 3 in back-to-back relationship makes for an efficient closed circuit for the flow of the shot.

Figure 10:
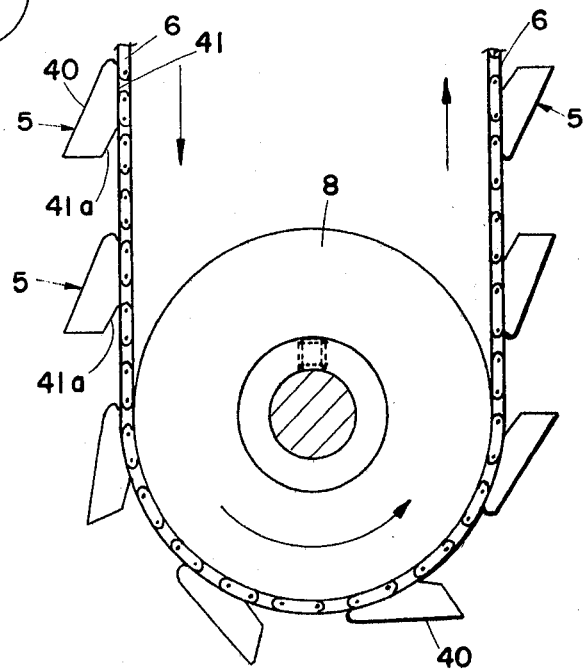
FIG. 10 is a more detailed view of the lower end of the elevator assembly showing the toothless sprocket and arrangement of elevator buckets.

Now referring to the elevator assembly 4, it will be seen by FIGS. 1, 2 and 10 that it includes endless link chain 6 extending around the lower sprocket 8 and the upper sprocket 7. Sprocket 7 is conventional and thereby has teeth 7*a* which engage the chain 6. Sprocket 7 is driven by the elevator drive assembly 15 while sprocket 8 is an idler. Idler sprocket 8 is toothless which prevents any interference by the steel shot between the teeth of the conventional sprocket generally used with link chain. Attached to the chain 29 are the buckets 5. These buckets are elongated buckets extending the entire width of the elevator chamber 2 (see FIG 3). As will be described hereinafter, these buckets are substantially the same length as the length of the screen 14 located in bucket 13 of the bucket assembly 12. The reason for this is that the depth of the steel shot in the bucket 13 should be uniform throughout its length and, as a result, the elongated elevator buckets 5 in which the steel shot is evenly distributed along their entire length, feed the steel shot to the screen 14 in an even distribution along the entire length thereof.

The buckets 5 are especially designed for being sure that the steel shot is dispensed into the impact chamber 3. This special design is the inclined wall 40 which joins with the vertical wall 41 which is attached to the chain 29. The extreme end of the vertical wall 41 opposite the end which is adjacent to the wall 40 is also inclined in generally the same direction as the wall 40. This extreme end 41*a* thus directs steel shot in a direction away from the chain as the shot is dumped when the elevator buckets pass over the top sprocket 7. As illustrated by FIG. 1, when the shot is dumped out of the elevator buckets, that shot which might tend to fall in a vertical direction strikes the inclined wall 40 causing it to bounce into the chute 9 of the impact chamber 3.

Figure 6:
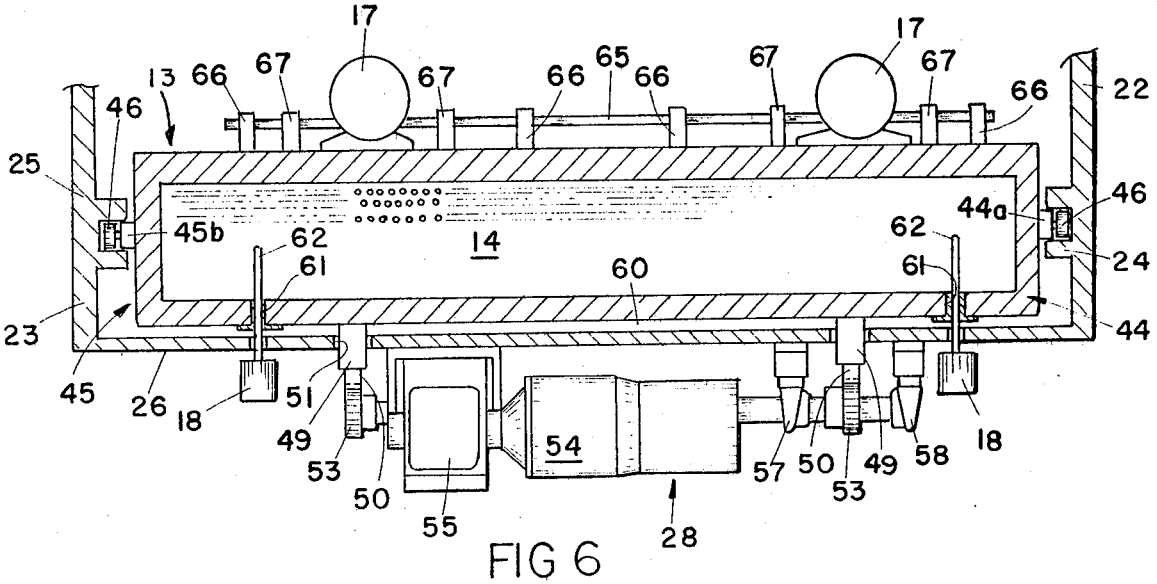
FIG. 6 is a cross-sectional top view of the bucket assembly taken through the plane VI—VI of FIG. 1 and showing the mechanism for vertically adjusting the bucket in the impact chamber.

The bucket assembly 12 previously referred to in relation to FIG. 1 is more clearly illustrated by FIGS. 4, 5, 6 and 7. It includes an elongated rectangular bucket 13 extending from one side 22 of chamber 3 to the opposite side 23 (FIG. 3). The two ends 44 and 45, FIGS. 4, 5, and 6, of the bucket 13 include the guide rails 44*a* and 45*a*, respectively, on which are rotatably mounted the rollers 46 and 47. These rails 44*a*, 45*a* and rollers 46, 47 ride in tracks 24 and 25 (FIG. 6) on the inner side of the walls 22 and 23. One such track 24 is illustrated in FIG. 3. At the front of the bucket 13 are the guide rails 49 supporting the gear rack 50 as illustrated by FIGS. 3 and 6. The guide rails 49 extend through the elongated openings 51 of the front wall 26 so that the racks 50 can be driven by the motor driven gears 53.

Figure 7:
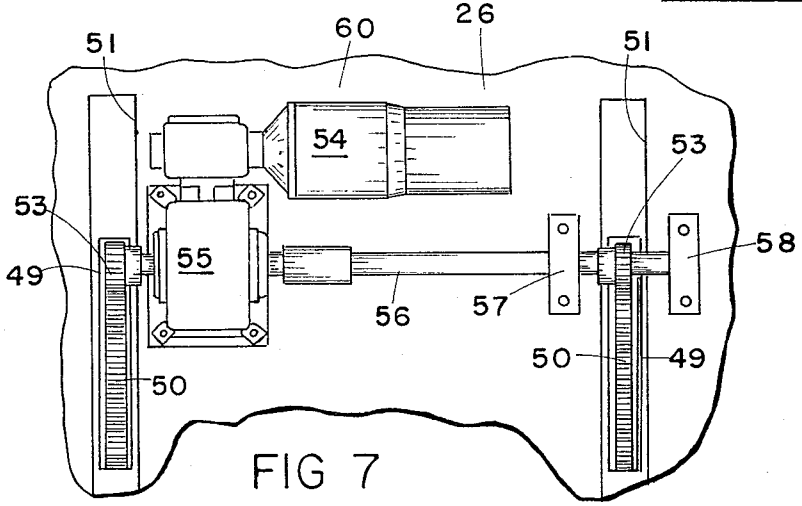
FIG. 7 is an elevational view illustrating the mechanism and drive for vertically adjusting the bucket assembly.

As disclosed in FIGS. 6 and 7, the adjustment mechanism which drives the gears 53 to raise and lower the bucket assembly 12 includes the motor 54 operatively connected to a reducer gear 55 which drives the shaft 56 mounted in the bearings 57 and 58. Mounted on the shaft 56 are the gears 53 the teeth of which engage the teeth of the gear racks 50. As evident from FIGS. 3, 6 and 7, the rails 49 are adjustable in the slots 51 of the front wall 52. Thus, driving the gears 53 adjusts the racks vertically within the openings 51 to thereby adjust the vertical position of the bucket 13 inside the impact chamber 3.

Mounted on the bucket assembly 12 and extending through the front wall 60 of the bucket 13 are two sensors 18 housing probes or sensor elements 62 (FIG. 6) which move along with the bucket assembly as it is being vertically adjusted. Therefore, also in the front wall 26 of the chamber 3 are the openings 61 provided for the purpose of permitting movement of the sensor probes 62 of sensors 18 with the bucket 13. The sensors 18 including probes 62 are of any well-known, conventional type that will sense the presence of the media within the bucket. One such sensor is sold by the Industrial Instrumentation Division of Robertshaw Controls Company of Anaheim, Calif. It is identified by the name "Level-Tek Model 304A" which is believed to be a trademarked term of Robertshaw Controls Company. These are specifically provided to indicate that the level of shot above the screen 14 is uniform and is of a sufficient depth to give the desired stream of shot passing through the screen and falling on the workpiece.

Figure 4:
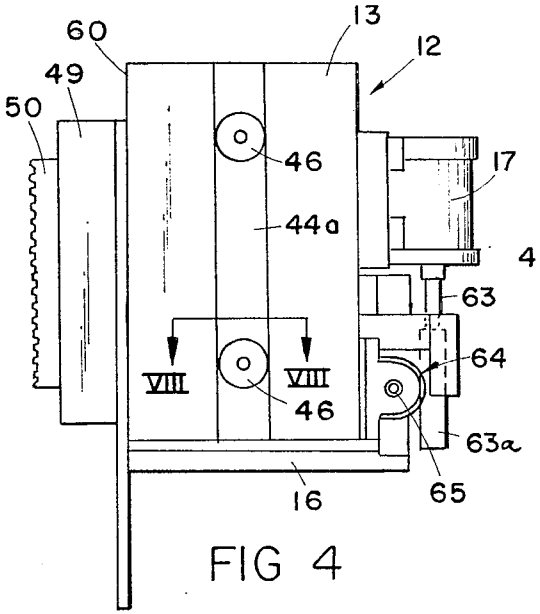
FIG. 4 is a side-elevational view of the bucket assembly.

The bucket assembly 12 also includes a door 16 normally extending downwardly out of the path of the falling shot. This door can be closed by the air cylinders 17 which actuate the racks 63*a* (FIG. 4) attached to the piston rods 63. The teeth of racks 63*a* engage the teeth of gear sector 64 formed integral with the door 16 mounted on the rod 65 for pivotal movement about the axis of rod 65. Thus, as best shown by FIG. 4, withdrawal of the rod 63 causes actuation of the gear rack 63*a* upwardly resulting in the counterclockwise rotation of the sector gear 64 about axis 59 causing door 16 to open.

Door 16 is generally open during the operation of this apparatus and is closed only when it is desirable to discontinue dropping the shot on the workpieces. This occurs when the housing door 21 is open and the workpieces are not in proper position or with the probes 62 of sensors 18 sense a low or uneven supply of shot in the bucket 13. As disclosed in FIG. 5, the door 16 is hinged by rod 65 which is journaled in the journal supports 66. The door hinge elements 67 support the door on the rod 65.

Figure 8:
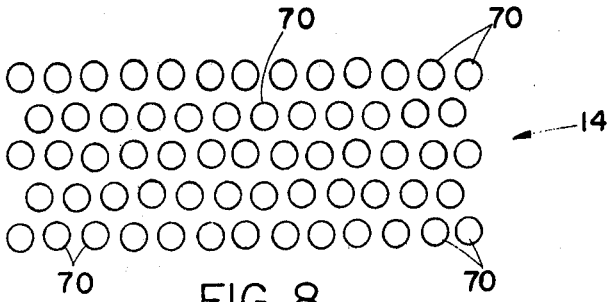
FIG. 8 is a partial cross-sectional view taken along the plane VIII—VIII of FIG. 4 illustrating the pattern of the openings in the perforated plate or screen.
Figure 9:
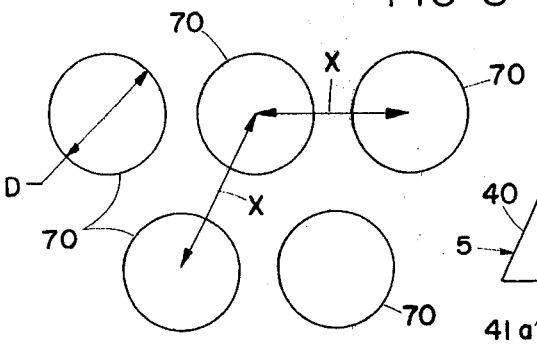
FIG. 9 is a greatly enlarged plan view of a few of the openings in the perforated plate or screen to illustrate the size and spacing of the openings.

One aspect of the perforated plate or screen 14 is the size and spacing of the openings. The pattern, size and spacing of these openings is disclosed in FIGS. 8 and 9. These two figures disclose the staggered relationship of the openings 70. FIG. 9 discloses the diameter "D" and the center-to-center spacing "X". We have discovered that to properly compress and smooth the surfaces of a turbine blade constructed of a titanium alloy (Ti-6Al-4V by weight) the dimensions of the hole diameter "D", the center-to-center hole spacing "X", the diameter "$d_s$" of the shot being utilized, and the spacing "Y" of the screen 14 above the workpiece 43 should be as follows:

D=7/32 inches
X=11/32 inches
$d_s$=0.070 inches
Y=24 inches

The importance of these dimensions was discovered when it was determined that too many balls falling into close relationship interfered with each other as they bounced off the workpiece being treated while an insufficient number did not create the necessary impact on the surface of the workpiece. It was discovered that those that bounced off interfered with those that were falling on the surfaces of the workpiece and only after painstaking experimentation were we able to determine the above dimensions.

OPERATION

Having described the details of all the features and components of this invention, the operation thereof should be evident. Starting with the shot falling to the bottom of the impact chamber 3 and into the bottom of the elevator chamber 2, the shot is carried upwardly by the buckets 5 of the elevator assembly 4. The buckets as disclosed in the top cutaway portion of FIG. 3 are approximately the same length as the bucket 13 of the bucket assembly 12. The shot is evenly distributed along the entire length of the buckets 5 by virtue of all portions along the length picking up substantially the same amount of shot. Also as the buckets 5 travel upwardly, if not evenly distributed at the bottom of the elevator housing 2, the shot will become evenly distributed as the buckets are carried upwardly by the chain 29. As the chain 29 passes around the toothless sprocket 8, there is very little interference caused by any shot lodging in between the sprockets and the chain. This was made possible by the elimination of the conventional teeth on the sprockets.

When the buckets 5 reach the top and turn around the corner of the sprocket 7 the shot is dumped out of the buckets 5 and into the funnel 9 which funnels the shot into the bucket assembly 12. In passing from the elevator chamber into the funnel 9, as illustrated in FIG. 1, the shot drops either directly into the funnel or drops downwardly and hits the inclined surface of the slanted side or wall 40 of the bucket directly underneath. The shot then bounces off into the space above the funnel 9.

When the apparatus is in operation, the shot passes through the apertures 70 (FIGS. 8 and 9) of the perforated plate or screen 14 (FIGS. 1 and 6). The distribution of the shot falling through the openings is controlled by the pattern, size and center-to-center dimensions of the openings 70, it being important that not too many of the shot fall through the perforated plate 14 at one time because they would interfere with each other upon impacting the workpiece 43.

Further, we have found it important that in order to uniformly treat the workpieces in the zone located under the entire length of the screen, the depth of the shot be as uniform as possible. Therefore, we have provided the sensors 18 located at each end of the bucket 13 above the screen 14. These sensors are connected to a signal that will indicate lack of shot at one end or the other. This signal can be used to show a visual indication or can cause the door 16 to be closed by actuation of the air cylinder 17.

The door 16 is also closed when the door 21 containing the manipulating mechanism 31 is opened. Under such conditions, with the door closed, there is not shot stream falling downwardly from the bucket assembly 12. However, the elevator 4 continues to run, unless shut off, to elevate the shot and convey it into the bucket assembly 12 where it piles up until no further shot is picked up in the elevator housing 2. When the operation is to be resumed, the air cylinder 17 is actuated opening the door 16 permitting the shot to flow through the openings 70 of the perforated plate or screen 14 so as to produce the shot stream flowing downwardly into the zone where the workpieces are held and manipulated by the manipulator mechanism 31.

In the event the acceleration and the velocity of the shot is to be increased or decreased, the motor 54 is energized to drive the spur gears 53 which engage the racks 50 to either raise or lower the entire bucket assembly 12 depending upon the direction of rotation of the motor 54. Thus, the entire bucket assembly 12 including the sensors 18 can be adjustable in elevation, such adjustment controlling the acceleration and velocity of the shot as it impacts the workpieces 43.

Having described our invention, it should be understood that the above description is intended to be that of a preferred embodiment of the invention. Various changes and alterations might be made without departing from the spirit and broad aspects of the invention as set forth in the appended claims, which are to be interpreted in accordance with the principles of patent law, including the doctrine of equivalents.

The embodiments of the invention in which an exclusive property or privilege is claimed are defined as follows:

1. Apparatus for treating workpieces with gravity accelerated media comprising:

a housing having a first chamber through which the media is dropped;

a second chamber containing an elevator means for elevating said media from the lower end of said second chamber to the upper end thereof;

support means for supporting workpieces intermediate the upper and lower ends of said first chamber;

means located at the upper sections of said chambers for causing said media to pass from the upper end of said second chamber to the upper end of said first chamber and fall downwardly through said first chamber; and means at the lower sections of said chambers for causing the media to pass from said first chamber to said second chamber so it can be elevated by said elevator means to the upper sections of said chambers, the improvement comprising:

a screen located intermediate said upper end of said first chamber and the portion of said first chamber where said support means supports said workpieces, said screen being elongated and extending in a direction along the width of said first chamber; said elevator means having elongated media carriers extending along the width of said second chamber, said lengths of said carriers being substantially the same lengths as said screen for feeding media evenly along the entire length of said screen.

2. The apparatus of claim 1 in which means is provided above said screen for sensing whether the depth of said media is substantially the same throughout the length of said screen to determine the uniformity in the quantity of media passing through said screen along its length.

3. The apparatus of claim 1 in which means is provided for closing off the flow of media through said screen.

4. The apparatus of claim 1 in which means is provided for adjusting the height of said screen above said support means for said workpieces to control the intensity of the impingement of said media on said workpieces.

5. The apparatus of claim 1 in which said elevators comprise a plurality of elongated bucket means mounted intermediate the ends thereof on endless carrier means, said carrier means passing over and being supported by a tooth sprocket mounted at the upper portion of said second chamber and a toothless sprocket mounted at the lower portion of said second chamber.

6. The apparatus of claim 1 in which the elevator means comprises a plurality of elongated buckets extending substantially along the entire width of the screen, said buckets being mounted on an endless carrier means in parallel relation to each other; said buckets in vertical cross section having at least two sides, one extending in a vertical direction when moving between the upper and lower ends of said second chamber; the other of said sides being inclined to said vertical direction; said sides being secured together to form a cup-like structure when moving in an upwardly direction; said inclined side being inclined toward said first chamber when moving in a downward direction, said inclined side when moving in said downward direction being located in the path of media being dumped by a bucket located thereabove causing the deflection of said media in a direction toward and into said first chamber.

7. Apparatus for treating workpieces with gravity accelerated media comprising:

a housing having a first chamber through which the media is dropped;

a second chamber containing an elevator means for elevating said media from the lower end of said second chamber to the upper end thereof;

support means for supporting workpieces intermediate the upper and lower ends of said first chamber;

means located at the upper sections of said chambers for causing said media to pass from the upper end of said second chamber to the upper end of said first chamber and fall downwardly through said first chamber; and means at the lower sections of said chambers for causing the media to pass from said first chamber to said second chamber so it can be elevated by said elevator means to the upper sections of said chambers, the improvement comprising:

a load bucket mounted in said first chamber intermediate the upper end of said first chamber and the portion of said first chamber where said support means supports said workpieces, said load bucket having a lower opening with a screen having uniformly sized and spaced openings located therein; and means for directing said media into said load bucket from said elevator means;

and a closure member adapted for closing or opening the entire lower opening of said load bucket whereby when closed a predetermined quantity of media can accumulate in said load bucket before said media is permitted to pass through said screen and when opened an evenly distributed medium passes through the screen throughout the entire area of said opening.

8. The apparatus of claim 7 in which sensing means is provided in said load bucket above said screen for sensing whether the depth of said media is substantially the same throughout the length of said screen to determine the uniformity in the quantity of media passing through said screen along its length.

9. The apparatus of claim 8 in which the closure member provided for closing off the lower opening in said load bucket is responsive to the sensing means whereby said closure means is held closed if the depth of the media is not at a predetermined level.

10. The apparatus of claim 7 in which means is provided for adjusting the height of said load bucket above said support means for said workpieces to control the intensity of the impingement of said media on said workpieces.

11. The apparatus of claims 2 or 8 in which said sensing means comprises sensor probes extending above said screen at least adjacent the ends of said screen.

12. The apparatus of claim 6 in which said elevators comprise a plurality of elongated bucket means mounted intermediate the ends thereof on endless carrier means, said carrier means passing over and being supported by a tooth sprocket mounted at the upper portion of said second chamber and a toothless sprocket mounted at the lower portion of said second chamber.

13. The apparatus of claim 8 in which means is provided for adjusting the height of said load bucket above said support means for said workpieces to control the intensity of the impingement of said media on said workpieces, said sensing means also being movable with said load bucket so as to retain the distance of said sensing means above said screen.

14. Apparatus for treating workpieces with gravity accelerated media comprising:

a housing having a first chamber through which the media is dropped;

a second chamber containing an elevator means for elevating said media from the lower end of said second chamber to the upper end thereof;

support means for supporting workpieces intermediate the upper and lower ends of said first chamber;

means located at the upper sections of said chambers for causing said media to pass from the upper end of said second chamber to the upper end of said first chamber and fall downwardly through said first chamber; and means at the lower sections of said chambers for causing the media to pass from said first chamber to said second chamber so it can be elevated by said elevator means to the upper sections of said chambers, the improvement comprising:

a load bucket mounted in said first chamber intermediate the upper end of said first chamber and the portion of said first chamber where said support means supports said workpieces, said load bucket having a lower opening with a screen located therein; and means for directing said media into said load bucket from said elevator;

means for adjusting the height of said load bucket above said support means for said workpieces to control the intensity of the impingement of said media on said workpieces including track means for supporting the upward and downward movement of said load bucket within said first chamber; rack means secured to said load bucket and associated with a side of said first chamber and with a driving spur gear means mounted on said housing whereby actuation of said driving spur gear means causes upward and downward adjustment of said load bucket.

15. Apparatus for treating workpieces with gravity accelerated media comprising:

a housing having a first chamber through which the media is dropped;

a second chamber containing an elevator means for elevating said media from the lower end of said second chamber to the upper end thereof;

support means for supporting workpieces intermediate the upper and lower ends of said first chamber;

means located at the upper sections of said chambers for causing said media to pass from the upper end of said second chamber to the upper end of said first chamber and fall downwardly through said first chamber; and means at the lower sections of said chambers for causing the media to pass from said first chamber to said second chamber so it can be elevated by said elevator means to the upper sections of said chambers, the improvement comprising:

a load bucket mounted in said first chamber intermediate the upper end of said first chamber and the portion of said first chamber where said support means supports said workpieces, said load bucket having a lower opening with a screen located therein; and means for directing said media into said load bucket from said elevator means; and means for adjusting the height of said load bucket above said support means for said workpieces to control the intensity of the impingement of said media on said workpieces including a gear rack secured to said load bucket and extending in a substantially vertical direction; a spur gear engaging said gear rack; and drive means for driving said spur gear to cause said gear rack to be raised or lowered to thereby raise or lower said load bucket.

16. The apparatus of claim 15 in which the gear rack extends from the inside of said first chamber through a vertical opening in one of the walls of said first chamber and said spur gear and drive means are located outside the said housing.

* * * * *